US011583083B2

(12) United States Patent
Schuster

(10) Patent No.: US 11,583,083 B2
(45) Date of Patent: Feb. 21, 2023

(54) SEATING FURNITURE HAVING A WALL-AWAY FUNCTION AND A FOOT PART THAT CAN BE PIVOTED OUT

(71) Applicant: Michael Schuster, Hannover (DE)

(72) Inventor: Michael Schuster, Hannover (DE)

( * ) Notice: Subject to any disclaimer, the term of this patent is extended or adjusted under 35 U.S.C. 154(b) by 0 days.

(21) Appl. No.: 17/596,934

(22) PCT Filed: Jun. 28, 2020

(86) PCT No.: PCT/DE2020/100559
§ 371 (c)(1),
(2) Date: Dec. 22, 2021

(87) PCT Pub. No.: WO2021/000993
PCT Pub. Date: Jan. 7, 2021

(65) Prior Publication Data

US 2022/0312967 A1 Oct. 6, 2022

(30) Foreign Application Priority Data

Jun. 29, 2019 (DE) ..... 10 2019 117 623.9

(51) Int. Cl.
*A47C 1/034* (2006.01)

(52) U.S. Cl.
CPC ..... *A47C 1/034* (2013.01)

(58) Field of Classification Search
CPC ..... A47C 1/0355; A47C 1/022; A47C 1/0345; A47C 1/034; A47C 1/037
See application file for complete search history.

(56) References Cited

U.S. PATENT DOCUMENTS 3,400,975 A 9/1968 Rogers
3,493,264 A 2/1970 Re
(Continued)

FOREIGN PATENT DOCUMENTS

DE 2425731 A1 1/1975
DE 29708057 U1 7/1997
(Continued)

OTHER PUBLICATIONS

International Search Report dated Oct. 1, 2020 in related/corresponding International Application No. PCT/DE2020/100559.
(Continued)

*Primary Examiner* — Sarah B McPartlin
(74) *Attorney, Agent, or Firm* — Patent Portfolio Builders PLLC

(57) ABSTRACT

An item of seating furniture includes a chassis, a seat part having a pivotable inclination, a back part pivotable relative to the seat part, and a foot part, which is connected to the seat part via a foot-part adjustment mechanism and can be pivoted out. To adjust the item of seating furniture from an upright sitting position into a lying position, the seat part is moved forward relative to the chassis. In the sitting position, the foot part is pivoted in, substantially underneath the seat part. In the lying position, the foot part is pivoted out, in front of the seat part, such that the seat part is extended by the foot part. When being pivoted into a lying position, the back part moves forward, together with the seat part, relative to the chassis, and therefore, in any pivoted position, the back part does not project, or only insignificantly projects, beyond the rear edge of the item of seating furniture.

21 Claims, 9 Drawing Sheets

(56) References Cited

U.S. PATENT DOCUMENTS

| | | | | |
|---|---|---|---|---|
| 3,865,432 | A | 2/1975 | Rogers et al. | |
| 5,588,710 | A | 12/1996 | Wiecek | |
| 9,433,295 | B2 * | 9/2016 | Crum | A47C 7/5068 |
| 9,808,090 | B2 * | 11/2017 | Carrera | A47C 7/506 |
| 11,297,947 | B2 * | 4/2022 | Murphy | A47C 1/022 |
| 2012/0248831 | A1 | 10/2012 | Garland | |
| 2015/0272329 | A1 | 10/2015 | Lawson | |
| 2019/0350362 | A1 * | 11/2019 | Lapointe | A47C 1/034 |

FOREIGN PATENT DOCUMENTS

| | | | |
|---|---|---|---|
| DE | 69609540 | T2 | 4/2001 |
| DE | 202016104352 | U1 | 8/2016 |
| DE | 202016104973 | U1 | 10/2016 |
| DE | 202016008342 | U1 | 8/2017 |
| DE | 102018100008 | A1 | 7/2019 |
| DE | 102018108896 | A1 | 7/2019 |
| DE | 102018108897 | A1 | 7/2019 |
| DE | 102018108898 | A1 | 7/2019 |
| WO | 2019134889 | A1 | 7/2019 |

OTHER PUBLICATIONS

Written Opinion dated Oct. 1, 2020 in related/corresponding International Application No. PCT/DE2020/100559.

Cilation of Office Action dated Jan. 13, 2018 in related/corresponding DE Application No. 10 2018 100 008.1.

Cilation of Office Action dated Jan. 4, 2019 in related/corresponding DE Application No. 10 2018 108 896.5.

Cilation of Office Action dated Jan. 4, 2019 in related/corresponding DE Application No. 10 2018 108 897.3.

Cilation of Office Action dated Jan. 4, 2019 in related/corresponding DE Application No. 10 2018 108 898.1.

International Search Report dated Feb. 13, 2019 in related/corresponding International Application No. PCT/EP2018/097048.

* cited by examiner

SEATING FURNITURE HAVING A WALL-AWAY FUNCTION AND A FOOT PART THAT CAN BE PIVOTED OUT

BACKGROUND AND SUMMARY OF THE INVENTION

Exemplary embodiments of the invention relate to a piece of seating furniture having a chassis, a seat part pivotable in the inclination, a back part pivotable relative to the seat part, and a foot part that can be pivoted out and is connected to the seat part via at least one foot-part adjustment mechanism, wherein, in order to adjust the piece of seating furniture from an upright sitting position into a reclining position, the seat part is displaced forwards relative to the chassis, wherein the foot part is pivoted in substantially below the seat part in the sitting position and is pivoted out in front of the seat part in the reclining position in such a way that the seat part is extended by means of the foot part.

In particular, the present invention relates to such seating furniture in which the backrest can be pivoted in a wall-away manner and which is therefore colloquially also referred to as sofas with wall-away function. This means that, when pivoted into a reclining position, the backrest moves forward together with the seat part relative to the chassis, so that the backrest does not, or only insignificantly, project beyond the rear edge of the seating furniture in any pivoted position.

From the publications DE202016104352U1 and US020150272329A1 (FIGS. 10, 11), seating furniture is known which, in addition to such a wall-away function, also has a floor-free design with a foot part pivoted in approximately parallel below the seat part and a slim design in the front seat area.

Furthermore, the seat part, the back part and the foot part of the above-mentioned seating furniture can be adjusted by means of linear actuators.

However, the disadvantage of the seating furniture known from the above-mentioned publications is that in each case a relatively short footrest is used that is pivoted in approximately parallel underneath the seat part, as a result of which, when the footrest is pivoted out, the user's feet protrude over the front edge of the footrest and thus have no support surface, so that the comfort of lying down for the user is restricted.

Based on the described prior art, exemplary embodiments of the invention are directed to further designing a seat of the generic type in such a way that, when using one or more linear actuators for adjusting the seat part, the back part and the foot part, the reclining comfort of the seat is improved.

In order to increase the reclining comfort of a piece of seating furniture according to the invention, a substantially longer footrest, which is pivoted in approximately parallel below the seat part, should be implemented in comparison with the seating furniture known from the printed publications DE202016104352U1 and US020150272329A1, so that, in the pivoted-out position of the foot part, a complete supporting surface for the feet of the user is ensured.

The adjustment mechanism used for pivoting the foot part should be designed to save installation space, so that a slim design of the seating furniture is possible in the front seat area and the foot part can be arranged below the lowest point of the adjustment mechanism.

Due to a lever geometry of the foot-part adjustment mechanism according to the invention in combination with an arrangement of the linear actuator for the seat-part/foot-part adjustment according to the invention, a substantially longer footrest pivoted in approximately parallel below the seat part can be used for the foot part than in seating furniture known from the prior art, since on the one hand, during a first phase of pivoting of the seating furniture from the sitting to the reclining position, the footrest is guided closer to the seat part and with a "flatter" curve of movement than in the known seating furniture, and on the other hand, in order to increase the distance between the front edge of the seat part and the support plane of the seating furniture, the inclination of the seat part is always adjusted first and only then is the foot part extended.

In accordance with the invention, this achieves a reclining length of the pivoted-out foot part such that a complete supporting surface for the user's feet is ensured.

BRIEF DESCRIPTION OF THE DRAWING FIGURES

An exemplary embodiment of the invention is described below with reference to the accompanying drawing, wherein.

DETAILED DESCRIPTION

Figure 1:
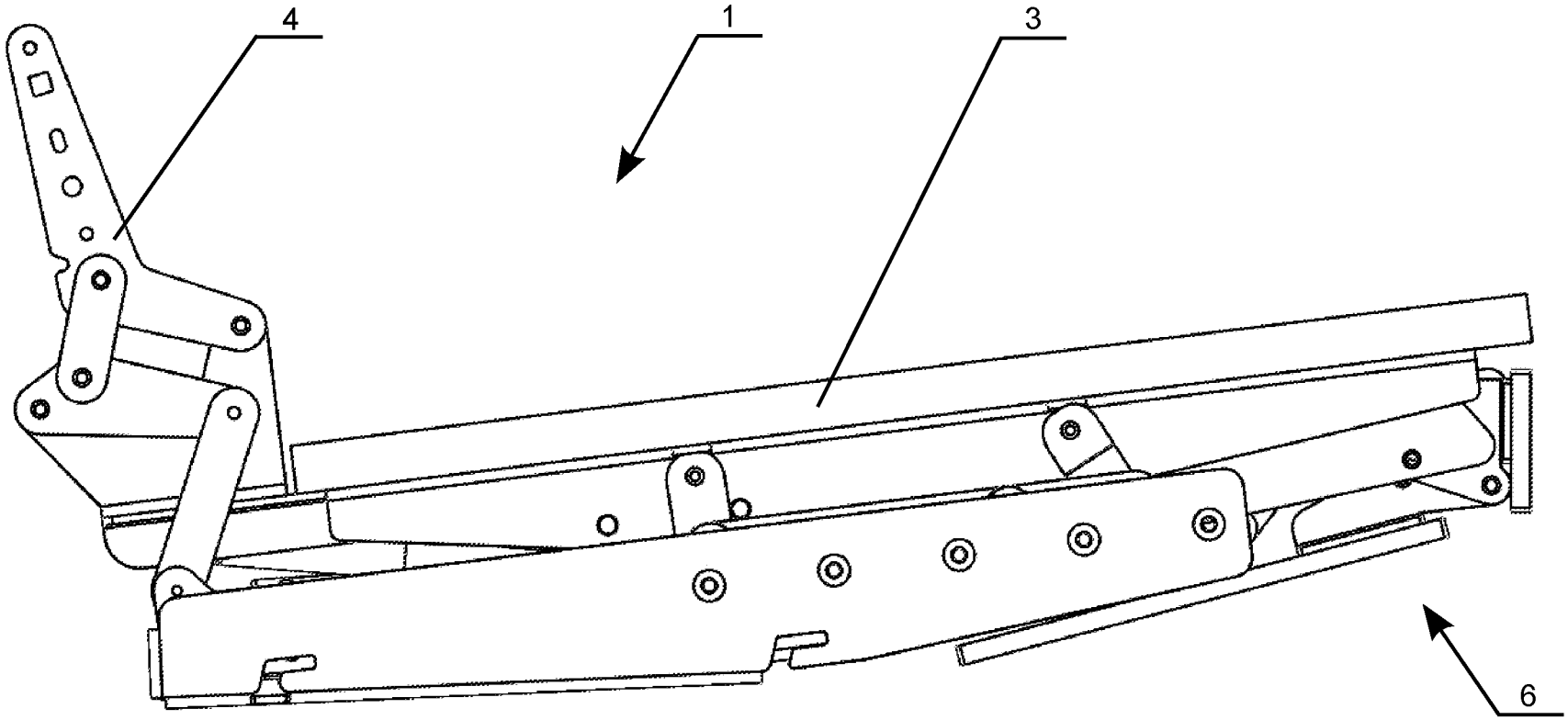
FIG. 1 shows a piece of seating furniture according to the invention in the sitting position of the seating furniture.

The illustrations in the drawing show essentially only the mechanism of the seating furniture 1 according to the invention, without the parts that are not of interest here, such as, in particular, upholstery.

Some components mentioned below are duplicated due to a largely mirror-image structure of the mechanics of the seating furniture 1. These components will be referred to in the singular in each case below, and both components are hereby meant in each case.

Figure 8:
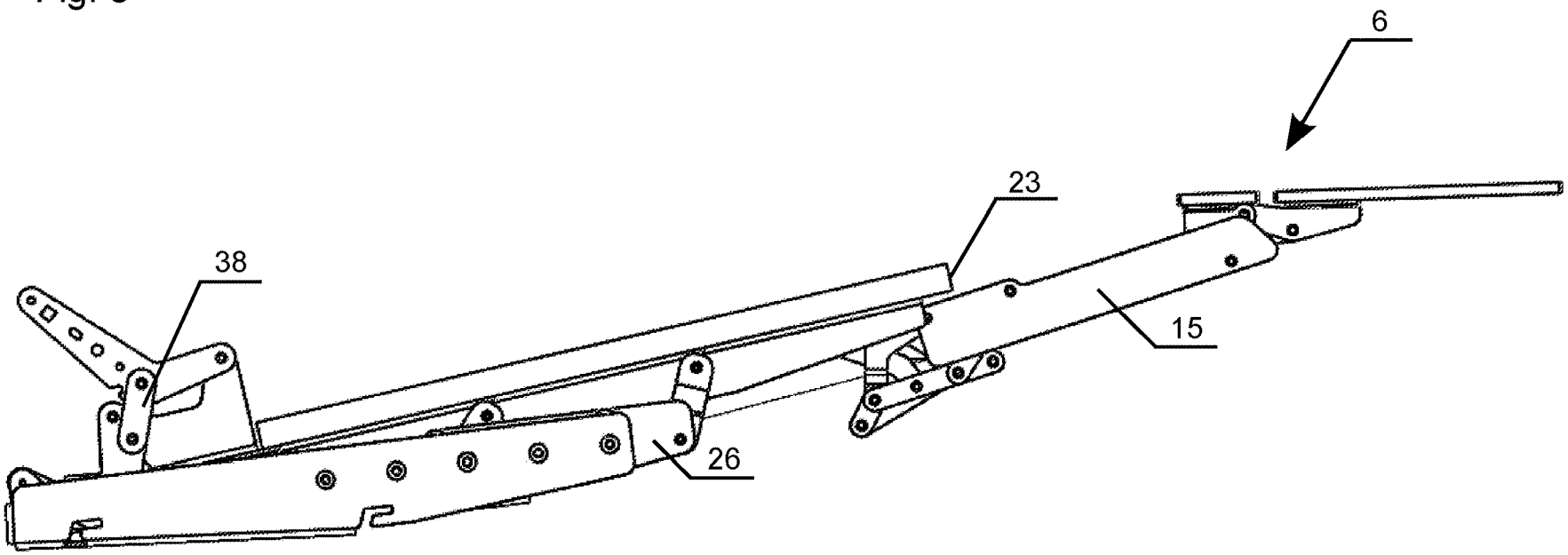
FIG. 8 shows a piece of seating furniture according to the invention in the reclining position of the seat.

A piece of seating furniture 1 according to the invention comprises a chassis 5, a seat part 3, a back part 4 connected to the seat part 3 and/or the chassis 5 via at least one back-part adjustment mechanism 2, and a foot part 6 that can be pivoted out, wherein the piece of seating furniture 1 is pivotable between a sitting position shown in FIG. 1 and a reclining position shown in FIG. 8.

The foot part 6 is connected to the seat part 3 via at least one foot-part adjustment mechanism 9, in the form of at least five four-bar chains arranged one behind the other.

The foot part 6 is formed in two parts, wherein the foot part 6 comprises a first footrest **6*b* attached to a first foot-part fitting 6*a* and a second footrest 6*d* attached to a second foot-part fitting 6*c*, wherein the first 6*a* and the second foot-part fitting 6***c* are coupled to each other in such a way that the first footrest 6*b* attached to the first foot-part fitting 6*a* is pivoted from the sitting position, in which the second footrest 6*d* attached to the second footrest fitting 6*c* preferably forms a front panel and the first footrest 6*b* is pivoted in below the seat part 3, into the reclining position in which the second footrest 6*d* forms with the first footrest 6*b* an extension of the seat part 3 adjoining the seat part 3, wherein the first footrest 6*b* is pivoted into an approximately horizontal position extending the end of the pivoted-out second footrest 6*d* remote from the seat part 3.

In the pivoted-in position, the first footrest 6*b* is arranged at least partially below the lowest point of the foot-part adjustment mechanism 9 and preferably approximately parallel to the seat part 3.

The foot-part adjustment mechanism 9 of the seating furniture 1 according to the invention comprises five four-bar chains arranged one behind the other, wherein, in the sitting position of the seating furniture 1, a first 10 and/or a second articulated lever 11 is/are articulated to the seat part 3 and a longitudinal axis formed between the two end articulation points 18, 19 of at least one of the first 10 and/or the second articulated lever 11 is arranged obliquely to the seat part 3, and in this case the end articulation point 18 of this articulated lever facing the seat part 3 is positioned closer to a vertical plane defined by the front edge 23 of the seat part than the end articulation point 19 of this articulated lever facing away from the seat part 3, wherein, in the sitting position of the seating furniture 1, a third 12 and a fourth articulated lever 13 have an orientation in which a longitudinal axis formed between the two end articulation points 20, 21 of at least one of the third 12 and/or the fourth articulated lever 13 is arranged obliquely with respect to the seat part 3, and in this case the end articulation point 21 of this articulated lever facing away from the seat part 3 is positioned closer to a vertical plane defined by the front edge 23 of the seat part than the end articulation point 20 of this articulated lever facing the seat part 3.

The terms "the end articulation point facing the seat part" and "the end articulation point facing away from the seat part" each refer to the shortest distance between an end articulation point of an articulated lever and the seat part, wherein an end articulation point of an articulated lever facing the seat part is at a shorter distance from the seat part than an end articulation point of this articulated lever facing away from the seat part.

Figure 5:
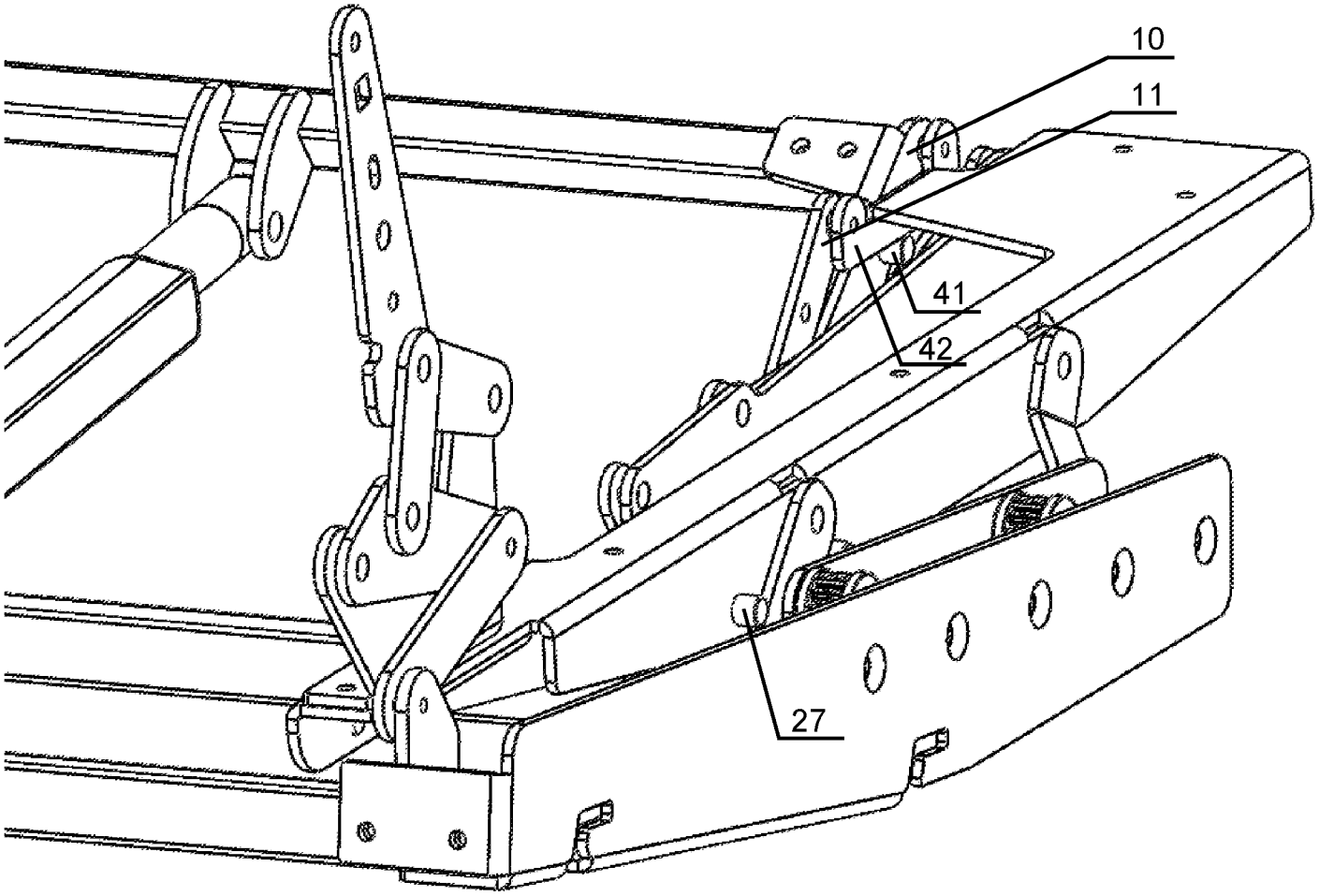
FIG. 5 shows a detailed view shows a piece of seating furniture according to the invention as shown in FIG. 3.

At least one of the first 10 and/or the second articulated lever 11 comprises a stop element 41 which, during the pivoting movement of the foot part 6, comes into contact with a stop surface of a seat part tab 42 connected to the front region of the seat part 3 (FIG. 5).

A fifth 14 and a sixth articulated lever 15 are, on the one hand, each articulated to the third 12 and/or the fourth articulated lever 13, and at least one of the fifth 14 and/or the sixth articulated lever 15 is, on the other hand, articulated to the second foot-part fitting 6*c* and forms a four-bar chain with the first 6*a* and the second foot-part fitting 6*c* and a connecting lever 37.

A coupling lever 16 is articulated, on the one hand, to the first 10 and second articulated levers 11 and, on the other hand, to the third 12 and fourth articulated levers 13.

A control lever 17 is articulated, on the one hand, to the first 10 or the second articulated lever 11 and, on the other hand, to the third 12 or the fourth articulated lever 13.

Figure 6:
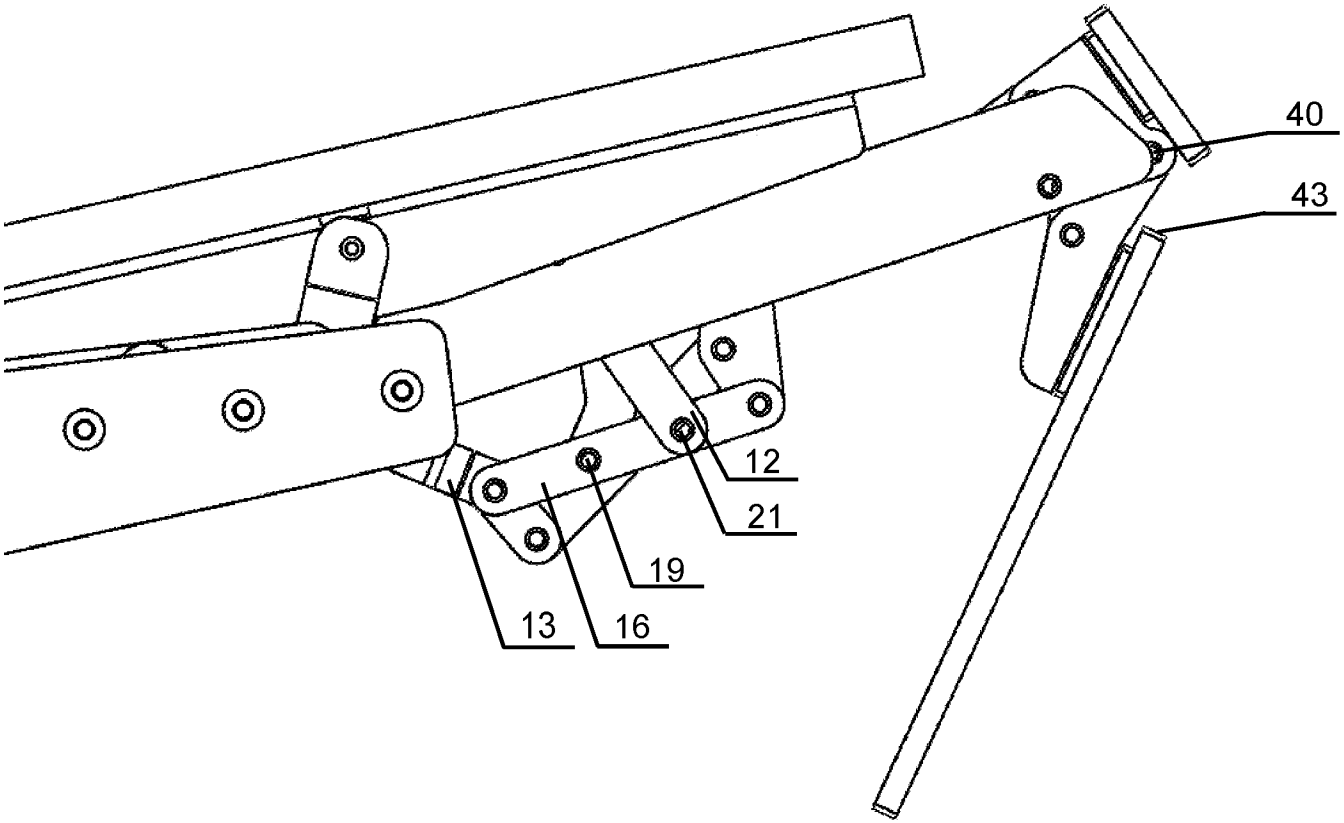
FIG. 6 shows a piece of seating furniture according to the invention as shown in FIG. 3 with a partially pivoted foot part.
Figure 9:
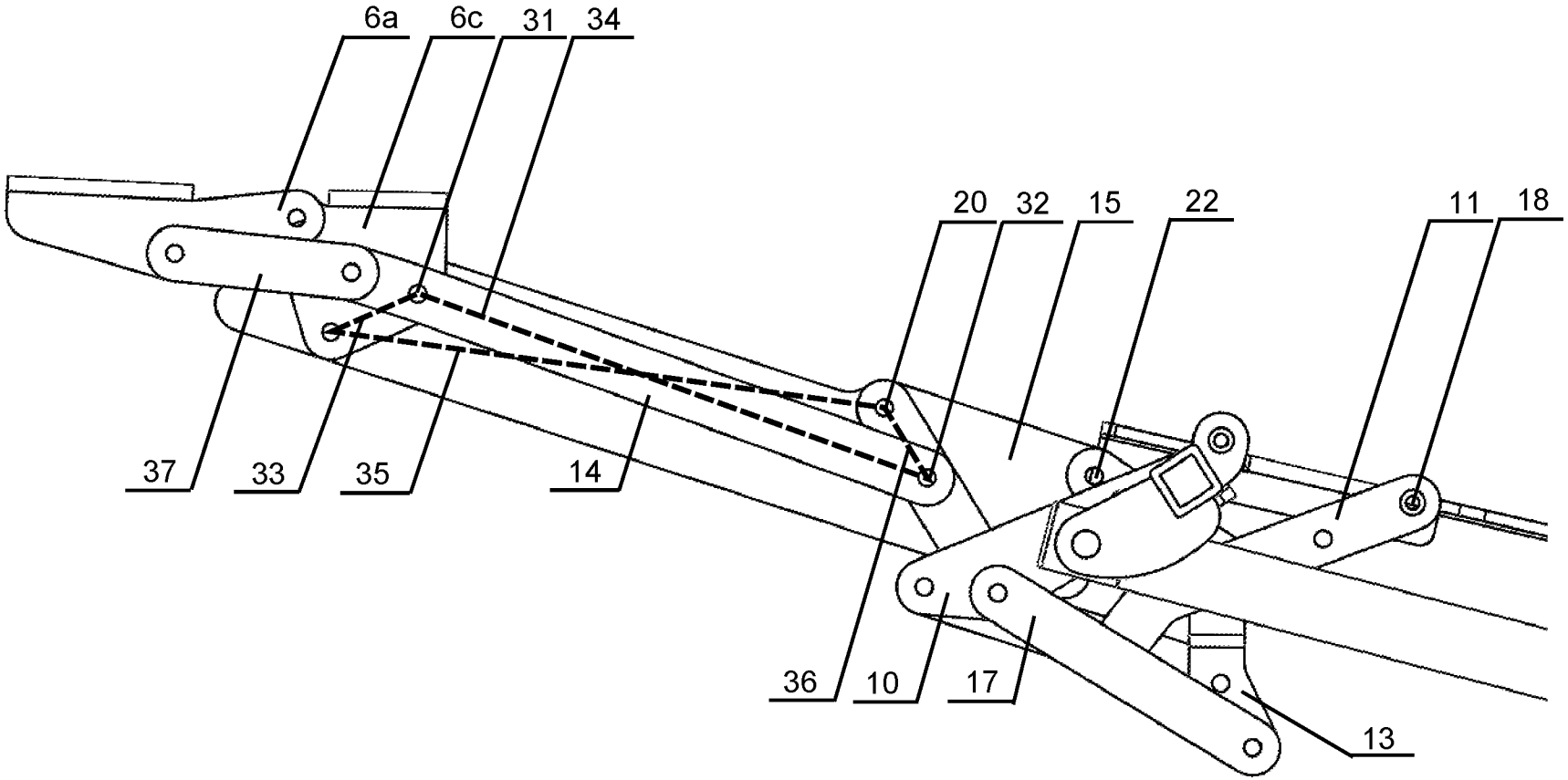
FIG. 9 shows a piece of seating furniture according to the invention as shown in FIG. 7 in a detailed view of the foot-part adjustment mechanism.

In a particularly preferred arrangement of the articulated, coupling and control levers 10, 11, 12, 13, 14, 15, 16, 17 according to the invention, the first 10 and the second articulated lever 11 are each articulated, on the one hand, to a front region of the seat part 3 and, on the other hand, each to the coupling lever 16, the third 12 and the fourth articulated lever 13 are each articulated, on the one hand, to the coupling lever 16 and, on the other hand, with their end articulation points 20, 22 facing the seat part 3 in the sitting position of the seating furniture 1, in each case to the sixth articulated lever 15, the sixth articulated lever 15 is furthermore articulated to the second foot-part fitting 6*c*, one of the third 12 and/or the fourth articulated lever 13 is extended beyond its articulation point to the coupling lever 16 and is articulated at its free end to a first end of the control lever 17, the second end of which is articulated to a central region of one of the first 10 and/or the second articulated lever 11, the third articulated lever 12 is positioned, in the sitting position of the seating furniture 1, closer to a vertical plane defined by the front edge 23 of the seat part than the fourth articulated lever 13, the fifth articulated lever 14 is articulated, on the one hand, to a central region of the third articulated lever 12 and, on the other hand, to the second foot-part fitting 6*c* (FIG. 6 and FIG. 9).

In this context, "a central region of the articulated lever" does not mean the exact geometric center, but the entire region of an articulated lever lying between the two end articulation points.

The first 6*a* and the second foot-part fitting 6*c* are preferably pivotally connected to each other and the fifth 14 and the sixth articulated lever 15 are articulated at a distance from each other to the second foot-part fitting 6*c*, wherein one of the articulated levers 14, 15 is extended beyond the region of its articulation point to the second foot-part fitting 6*c* and is articulated at its free end to the first end of the connecting lever 37, the second end of which is articulated to the first foot-part fitting 6*a* (FIG. 9).

During the adjustment of the seating furniture 1 from the sitting position to the reclining position, the first 10 and/or the second articulated lever 11 are pivoted in such a way that the coupling lever 16 is pushed forward with respect to the seat part 3, while at the same time the third 12 and the fourth articulated lever 13 are pivoted relative to the coupling lever 16 and, in the process, the first 6*a* and the second foot-part fitting 6*c* are pushed forward with respect to the coupling lever 16.

Due to the arrangement according to the invention and the cumulative pivoting movements of the first 10 and/or the second articulated lever 11, on the one hand, and of the third 12 and/or the fourth articulated lever 13, on the other hand, in which, during the adjustment of the seating furniture 1 from the sitting position to the reclining position, one of the first 10 and/or the second articulated lever 11 is pivoted by an angle of preferably more than 200° with respect to one of the third 12 and/or the fourth articulated lever 13, according to the invention, a large overall travel distance for the foot part 6 is achieved.

According to the invention, the first 10 and/or the second articulated lever 11 on the one hand and the third 12 and/or the fourth articulated lever 13 on the other hand are arranged in such a way that during an approximately first half of the adjustment of the foot part 6 from the pivoted-in sitting position to the pivoted-out reclining position, the coupling lever 16 is lowered relative to the seat part 3, wherein simultaneously all sections of the fifth 14 and/or the sixth articulated lever 15 and an articulation point 30 of one of the fifth 14 and/or the sixth articulated lever 15 on the second foot-part fitting 6*c* are raised relative to the coupling lever 16.

The lowering of the coupling lever 16 is thus quasi compensated for by a simultaneous raising of the fifth 14 and/or the sixth articulated lever 15 as well as of the first 6*a* and the second footrest fitting 6*c* relative to the coupling lever 16, whereby, in conjunction with a pivoting movement of the second footrest fitting 6*c* in the direction of the seat part 3, the effect is that the front edge 43 of the first footrest 6*b* follows an almost linear or a "flat" movement curve close to the front edge 23 of the seat part during a first phase of the pivoting from the sitting to the reclining position, or a "flat" movement curve near the front edge 23 of the seat part, wherein the movement curve of the articulation point 40 of the first foot-part fitting 6*a* on the second foot-part fitting 6*c* extends in an ascending manner with respect to a horizontal plane defined by this articulation point 40 in the sitting position of the seating furniture 1 during the entire pivoting of the foot part 6 from the sitting position into the reclining position.

The effect according to the invention of a "flat" movement curve of the front edge 43 of the first footrest 6*b* (FIG. 6) enables the use of a substantially longer first footrest 6*b* compared to the known generic seating furniture (see publications DE202016104352U1 and US020150272329A1), so that in combination with the above-mentioned large travel path of the foot part 6, a particularly long leg support surface can be provided according to the invention, in the pivoted-out position of the foot part 6.

During an approximately second half of the adjustment of the foot part 6 from the pivoted-in sitting position to the pivoted-out reclining position, the coupling lever 16 is raised relative to the seat part 3, with the articulation point 30 of one of the fifth 14 and/or the sixth articulated lever 15 on the second foot-part fitting 6*c* being simultaneously lowered relative to the coupling lever 16. This results in such a stretching of the foot-part adjustment mechanism 9 that a continuous cushion pad extending over the seat part 3 and foot part 6, which is not shown in the figures, is tightened in the pivoted-out position of the foot part 6.

According to the invention, the arrangement of the sixth articulated lever 15 and its articulation points 20*a*, 22*a*, 30 on the third 12 and the fourth articulated lever 13 as well as on the second footrest fitting 6*c* is of decisive importance for the desired functional sequence as well as for a design of the foot-part adjustment mechanism 9 which, according to the invention, particularly saves installation space.

In this respect, the sixth articulated lever 15 particularly preferably has a width of about 40-70 mm, wherein, in the sitting position of the seating furniture 1, the articulation points 20*a*, 22*a* of the third 12 and of the fourth articulated lever 13 are positioned on the sixth articulated lever 15 on the longitudinal side of the sixth articulated lever 15 facing the seat part 3, and the articulation point 30 of the second foot-part fitting 6*c* is positioned on the sixth articulated lever 15 on the longitudinal side of the sixth articulated lever 15 facing away from the seat part 3.

As a result, the sixth articulated lever 15 forms with the third 12 and the fifth articulated lever 14 as well as the second foot-part fitting 6*c* a four-bar chain 33, 34, 35, 36 which crosses in accordance with the invention, in which an imaginary connecting straight line 34 extending through the articulation points 31, 32 of the fifth articulated lever 14 on the third articulated lever 12 and the second footrest fitting 6*c* and an imaginary connecting straight line 35 extending through the articulation points 20*a*, 30 of the sixth articulated lever 15 on the third articulated lever 12 and the second footrest fitting 6*c* intersect each other (FIG. 9).

Figure 3:
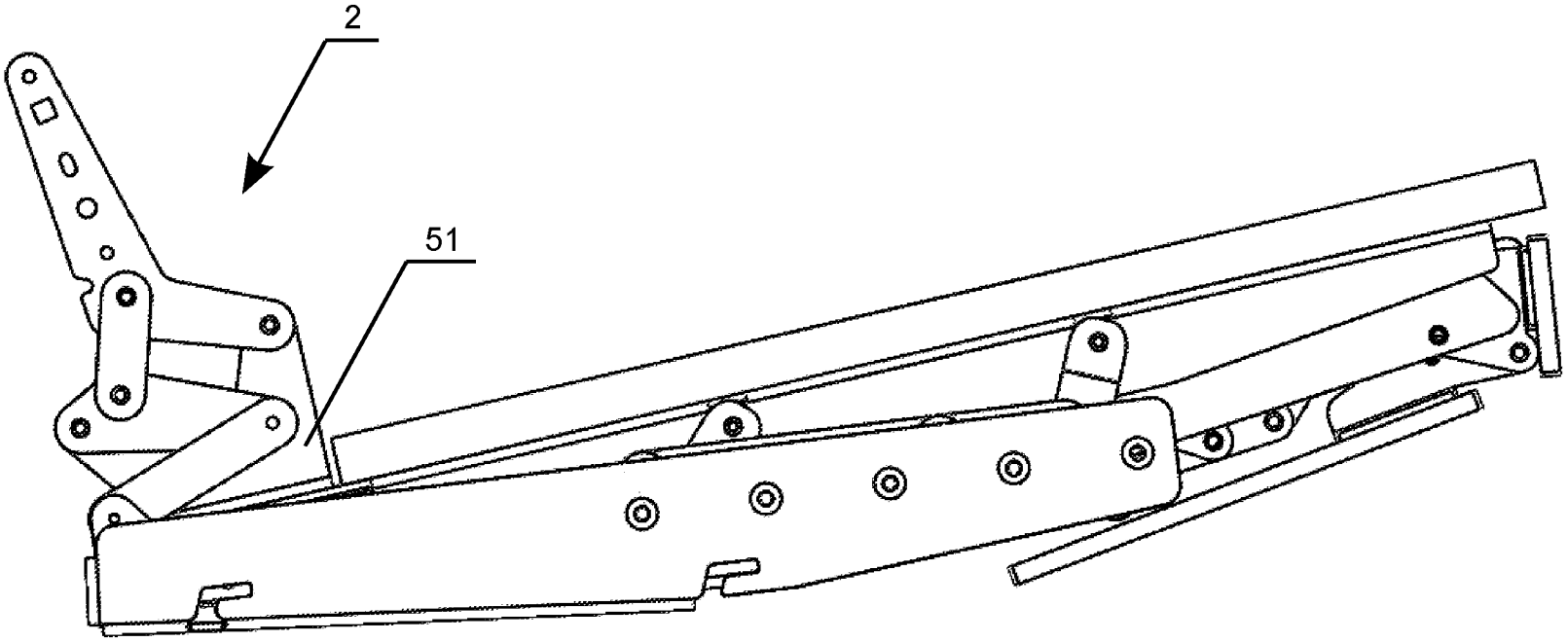
FIG. 3 shows a piece of seating furniture according to the invention in a first intermediate position.

Due to the intersecting active or connecting straight lines 34, 35, on the one hand the pivoting of the second footrest fitting 6*c* in the desired shape is ensured according to the invention, and on the other hand a particularly compact design of the foot-part adjustment mechanism 9 is made possible according to the invention, in which at least three four-bar chains of the foot-part adjustment mechanism 9, in the pivoted-in position, are located in approximately the same plane as the sixth articulated lever 15, so that the installation space occupied below the seat part 3 for the foot-part adjustment mechanism 9 is, according to the invention, not much more than the width of the sixth articulated lever 15 and the first footrest 6*b* can be arranged below the lowest point of the foot-part adjustment mechanism 9 (FIG. 3).

Furthermore, as a result of the sixth articulated lever 15, when the seating furniture is viewed from the side, in the reclined position of the seating furniture 1, at least one of the third 12 and/or the fourth articulated lever 13, the fifth articulated lever 14, the second foot-part fitting 6*c* and at least a partial region of the coupling lever 16 are largely covered by the sixth articulated lever 15, as a result of which only a linear structure of a lever plate extending flatly below the seat part 3 and the foot part 6 is perceptible to the viewer.

The foot-part adjustment mechanism 9 is actuated by a first linear actuator 28 preferably coupled to the first 10 or the second articulated lever 11.

The five four-bar chains of the foot-part adjustment mechanism 9, which are arranged one behind the other, are coupled to one another in such a way that the generation of a partial stroke at the first linear actuator 28 causes the first 10 and/or the second articulated lever 11 to pivot and thus, during the pivoting of the seating furniture 1 between the sitting position and the reclining position, causes the first footrest 6*b* to be forcibly pivoted in or out by an angle of preferably 150° to 180°.

The back-part adjustment mechanism 2 has a mounting plate 51 fixedly connected to the seat part 3 with a pivot lever 48 articulated thereto, which is further connected to the chassis 5 via a first connecting lever 39 and to the back part 4 via a second connecting lever 38.

The seat part 3 is displaceable and adjustable in inclination relative to the chassis 5 by means of a first 24 and a second displacement unit 25 from a sitting position displaced towards the rear edge of the seating furniture 1 to a reclining position displaced towards the front edge of the seating furniture 1.

The terms 'front edge of the seating furniture' and 'rear edge of the seating furniture' refer to the perspective of a person sitting on the seat with his or her legs facing forwards and his or her back facing backwards.

Figure 2:
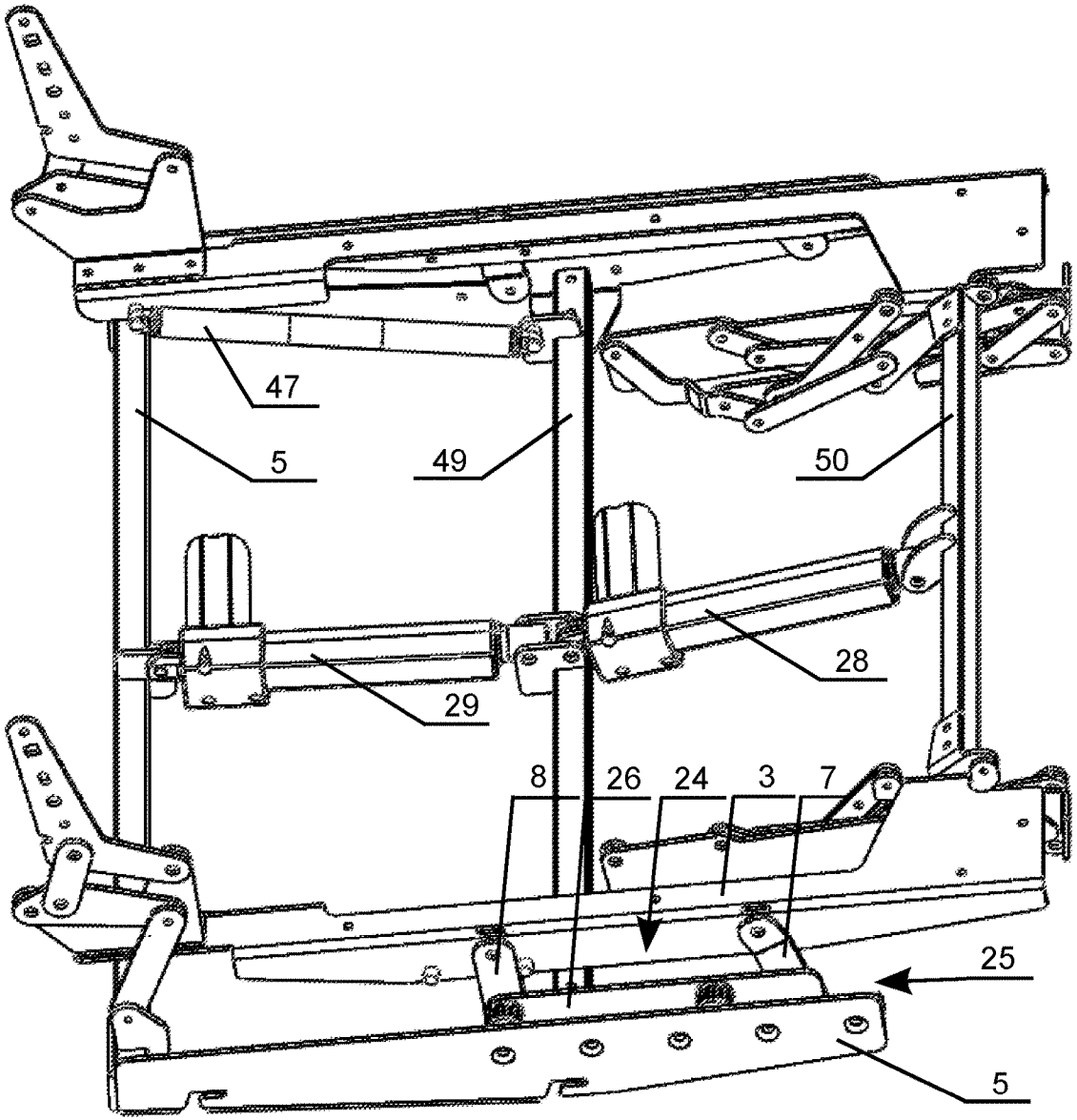
FIG. 2 shows a piece of seating furniture according to the invention as shown in FIG. 1 from a different perspective.

The first displacement unit 24 has a pivot guide, wherein a front 7 and a rear link lever 8 form a four-bar chain with the seat part 3 and an intermediate support 26 connected to the second displacement unit 25 (FIG. 2).

The pivoting movement of the first displacement unit 24 towards the front edge of the seating furniture 1 is blocked by a stop element 27 on the seat part side (FIG. 5).

Figure 4:
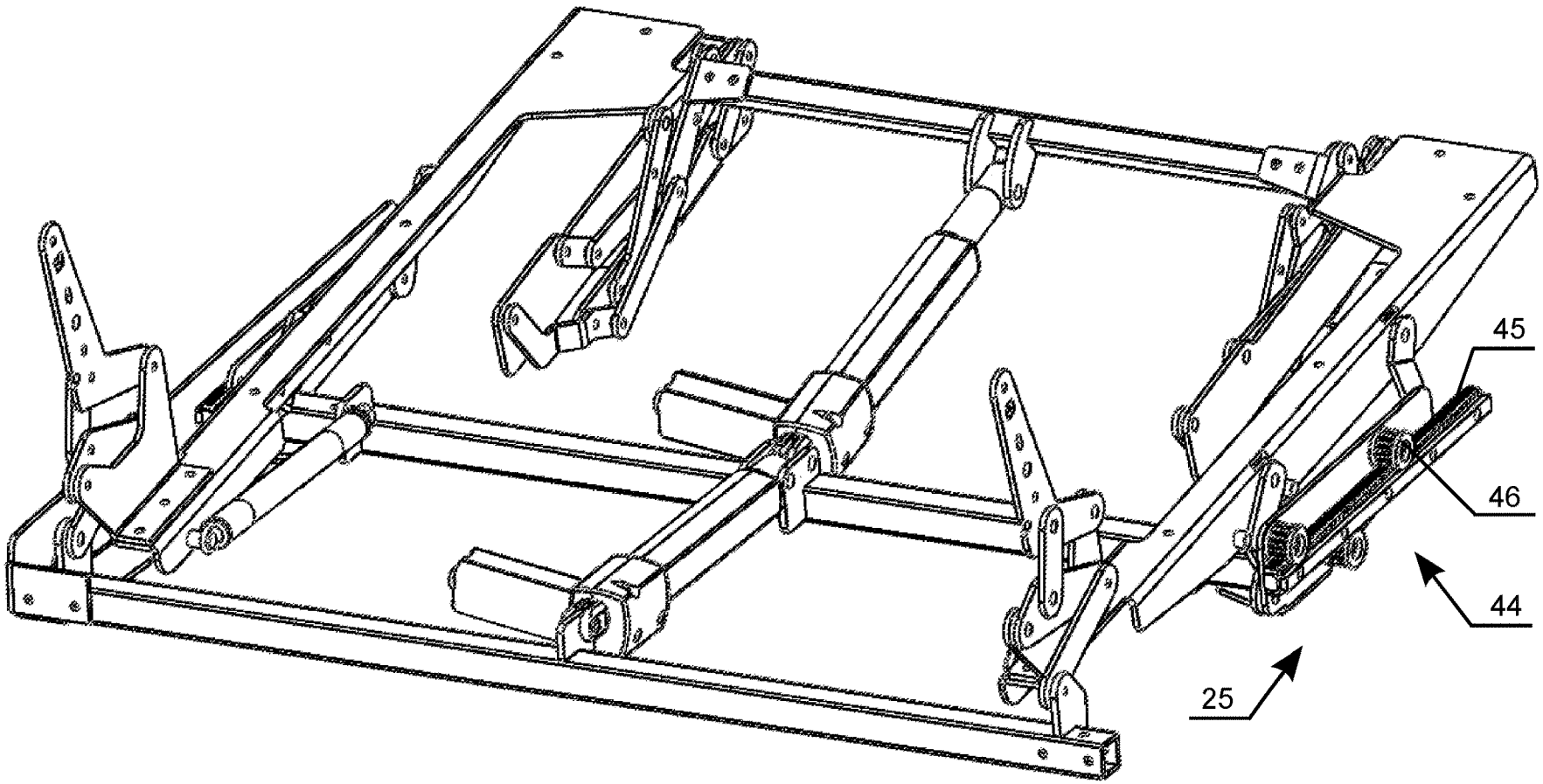
FIG. 4 shows a piece of seating furniture according to the invention as shown in FIG. 3 from a different perspective.

The second displacement unit 25 is formed by a linear or by an approximately linear guide system, preferably by at least one linear guide 44 in the form of a rack-and-pinion gear with gearwheels 46 movable along a rack segment 45, or by a lever adjustment mechanism, wherein the guide system, starting from the seating position of the seating furniture 1, is movable forwards along a path of movement relative to the chassis 5, wherein the path of movement is preferably linear and/or the path of movement rises in the forward direction (FIG. 4).

The first 24 and second displacement units 25 are attached to each other, wherein the intermediate support 26 is connected to the gearwheels 46 of the linear guide 44 and the linear guide 44 is further connected to the rack segment 45 on the chassis 5, whereby the first displacement unit 24 is slidably guided relative to the chassis 5.

The first displacement unit 24 is force-loaded by means of a tension spring 47 (FIGS. 2, 4).

The tension spring 47 is preferably coupled, on the one hand, to the seat part 3 and, on the other hand, preferably to the intermediate support 26 of the first displacement unit 24.

The first linear actuator 28 has a first end coupled to the first displacement unit 24 via a first transverse strut 49 connected to the intermediate support 26 of the first displacement unit 24, and a second end coupled to the foot-part adjustment mechanism 9 via a second transverse strut 50 connected to the foot-part adjustment mechanism 9 (FIG. 2).

According to the invention, the first transverse strut 49 is displaceably guided both relative to the chassis 5 and relative to the seat part 3.

A second linear actuator 29 has a first end coupled to the chassis 5 and a second end coupled to the first transverse strut 49 (FIG. 2).

This arrangement of the first 28 and the second linear actuator 29 according to the invention, in which the first linear actuator 28 is coupled at a first end to the first transverse strut 49, which is displaceably guided both relative to the chassis 5 and relative to the seat part 3, and at a second end to the foot-part adjustment mechanism 9 via the second transverse strut 50, which is connected to the foot-part adjustment mechanism 9, and the second linear actuator 29 is coupled at a first end to the chassis 5 and at a second end to the first transverse strut 49, which is guided displaceably both relative to the chassis 5 and relative to the seat part 3, enables an advantageous adjustment sequence, described below, of the seat part 3, the foot part 6 and the back part 4 between the sitting position and the reclining position of a piece of seating furniture 1 according to the invention.

In a piece of seating furniture 1 of the present invention, in the initial position or the seating position of the seating furniture 1, the second displacement unit 25 is held in its initial position by the second linear actuator 29 acting between the chassis 5 and the first transverse strut 49, furthermore, by means of the first linear actuator 28 acting between the first 49 and the second transverse strut 50, the foot part 6 is held in the pivoted-in end position by means of the stop element 41 acting between the seat part tab 42 and the foot-part adjustment mechanism 9, and the first displacement unit 24 is defined in its pivot position by the defined position of the foot part 6 and by means of the first linear actuator 28 (FIGS. 1,2).

The first linear actuator 28 generates a linear stroke when actuated, consisting of at least a first and a second partial stroke, wherein in a first adjustment step of the seating furniture 1 from the sitting position to the reclining position, which is effected by the first partial stroke of the first linear actuator 28, the seat part 3 is displaced forwards by means of the first displacement unit 24, and in the process the rear region of the seat part 3 is lowered and the front region of the seat part 3 is raised, so that the seat part 3 is adjusted in inclination with respect to the seat position of the seating furniture 1 until the rear guide lever 8 of the first displacement unit 24 comes into contact with a stop element 27 on the seat part side and the pivoting movement of the first displacement unit 24 is thereby blocked.

In this first intermediate position of the seating furniture 1, also referred to as the "lounge position", the foot part 6 has not yet been extended (FIGS. 3, 4, 5).

The tension spring 47 shortens during this first adjustment step and thereby supports the adjustment movement of the seat part 3, whereby the seat part 3 is adjusted first, without pivoting the foot part 6 relative to the seat part 3 (FIGS. 3, 4, 5).

Figure 7:
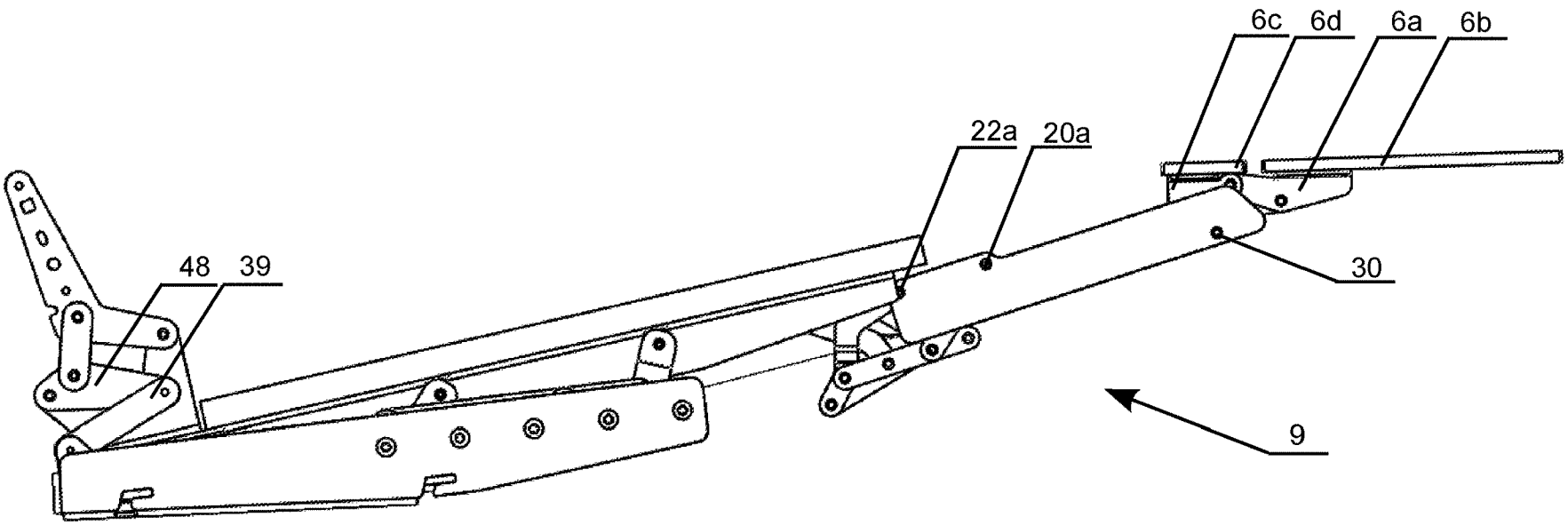
FIG. 7 shows a piece of seating furniture according to the invention in a second intermediate position.

In a second adjustment step of the seating furniture 1 from the sitting position to the reclining position effected by the second partial stroke of the first linear actuator 28, while maintaining the inclination and displacement position of the seat part 3 relative to the chassis 5 achieved at the end of the first partial stroke and while maintaining the position of the back part 4 relative to the seat part 3, an extension of the foot part 6 relative to the seat part 3 is effected until the foot part 6 has reached the pivoted-out end position, thus reaching a second intermediate position also referred to as the "relaxed position" (FIG. 7).

Due to this adjustment sequence, in which, when the first linear actuator 28 is actuated in the adjustment direction towards the reclining position of the seating furniture 1, in order to increase the distance between the front edge 23 of the seat part and the standing plane of the seating furniture 1, the inclination of the seat part 3 is always adjusted first, and only then is the foot part 6 extended, a larger pivoting space can be made available for the extending foot part 6 compared to the sitting position of the seating furniture 1, which makes it possible to use a longer first footrest 6*b*.

This, in combination with the above-described lever geometry of the foot-part adjustment mechanism 9 according to the invention for a long leg support surface in the pivoted-out position of the foot part 6, achieves such a reclining length of the pivoted-out foot part 6 that the object of providing a seating furniture of the generic type with a complete support surface for the feet of the user has thus been solved according to the invention.

In the reverse adjustment direction, i.e., in the direction of the seat position of the seating furniture 1, when the first linear actuator 28 is actuated, first the foot part 6 is retracted due to the spring force of the tension spring 47 to be overcome until the stop element 41 comes into contact with the stop surface of the seat part tab 42, and then the seat part 3 is adjusted to the starting position against the spring force of the tension spring 47.

A linear stroke generated by actuation of the second linear actuator 29 causes a third adjustment step of the seating furniture 1 from the sitting position to the reclining position, wherein during this adjustment step a forward displacement of the seat part 3 relative to the chassis 5 takes place by means of the linear guide 44 and thereby a wall-away pivoting of the back part 4 relative to the seat part 3, which is coupled to the displacement movement of the seat part 3 (FIG. 8).

All the aforementioned adjustment steps effected by the first linear actuator 28 and the second linear actuator 29 can be carried out separately and in any order or, optionally, simultaneously, ensuring that the back part 4 and the foot part 6 can be adjusted independently of one another and that the back part 4 and the seat part 3 can be adjusted independently of one another, so that in each adjustment position of the seat part 3 or of the foot part 6 a wall-away adjustment of the back part 4 into any desired pivot position is possible and in each adjustment position of the back part 4 the seat part 3 or the foot part 6 can be pivoted into any desired position.

The invention is not limited to the exemplary embodiment, but is variable in many ways within the scope of the disclosure.

All individual and combination features disclosed in the description and/or drawing are considered essential to the invention.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

The invention claimed is:

1. A piece of seating furniture, comprising:

a chassis;

a seat part, which is pivotable in inclination;

a back part;

a foot part, which is pivotable out and is connected to the seat part via at least one foot-part adjustment mechanism, wherein the piece of seating furniture is adjustable between a sitting position and a reclining position, wherein, at least during a partial phase of an adjustment of the piece of seating furniture from the sitting to the reclining position, the seat part is displaced forwards relative to the chassis, wherein, in the sitting position, the foot part is pivoted in below the seat part and in the reclining position the foot part is pivoted out in front of the seat part in such a way that the seat part is extended by the foot part, wherein, in the sitting position of the piece of seating furniture, a first footrest fastened to a first foot-part fitting of the foot part is arranged obliquely or parallel to the seat part and encloses an angle of 60° to 90° with a vertical plane defined by a front edge of the seat part, wherein, in the sitting position of the piece of seating furniture, a first or a second articulated lever is articulated to the seat part and a longitudinal axis formed between two end articulation points of at least one of the first and the second articulated levers is arranged obliquely with respect to the seat part, and a first one of the two end articulation points of the at least one of the first and the second articulated levers that faces the seat part is positioned closer to a vertical plane defined by the front edge of the seat part than a second one of the two end articulation points of the at least one of the first and the second articulated levers that faces away from the seat part, wherein, in the sitting position of the piece of seating furniture, a third and a fourth articulated levers have an orientation in which a longitudinal axis formed between two end articulation points of at least one of the third and of the fourth articulated levers is arranged obliquely with respect to the seat part and a first one of the two end articulation points of the at least one of the third and of the fourth articulated levers that faces away from the seat part is positioned closer to a vertical plane defined by the front edge of the seat part than a second one of the two end articulation points of the at least one of the third and of the fourth articulated levers facing the seat part, wherein a fifth and a sixth articulated lever are each articulated to the third or the fourth articulated lever, and at least one of the fifth or the sixth articulated lever is articulated to a second foot-part fitting coupled to the first foot-part fitting and forms a four-bar chain with the first foot-fitting part, the second foot-part fitting, and a connecting lever, wherein the third and the fourth articulated levers are each connected by their respective end articulation points facing the seat part in the sitting position of the piece of seating furniture to the fifth articulated lever or to the sixth articulated lever, wherein a control lever is articulated on the first or the second articulated lever and to the third or the fourth articulated lever, wherein a coupling lever is articulated to the first, second, third, or fourth articulated lever, wherein, during a partial phase of the adjustment of the piece of seating furniture from the sitting position into the reclining position, the coupling lever is configured to be lowered relative to the seat part, wherein at the same time an articulation point of one of the fifth and the sixth articulated levers on the second foot-part fitting is raised relative to the coupling lever, wherein a first and a second linear actuator are configured to adjust the seat part, the foot part, and the back part between the sitting and the reclining positions of the piece of seating furniture, wherein the first linear actuator, when actuated, produces a linear stroke consisting of at least a first and a second partial stroke, wherein the first linear actuator, during the adjustment of the piece of seating furniture from the sitting position into the reclining position, causes with the first partial stroke a forward displacement of the seat part relative to the chassis and a simultaneous inclination adjustment of the seat part, wherein during the first partial stroke of the first linear actuator no extension or retraction of the foot part relative to the seat part occurs, and wherein the first linear actuator, during the adjustment of the piece of seating furniture from the sitting to the reclining position, causes an extension of the foot part relative to the seat part with the second partial stroke after the first partial stroke.

2. The piece of seating furniture of claim 1, wherein the first footrest is pivoted through an angle of 150° to 180° during the adjustment of the piece of seating furniture from the sitting position to the reclining position.

3. The piece of seating furniture of claim 1, wherein the first and the second foot-part fitting are pivotably connected to each other, the fifth and sixth articulated levers are articulated at a distance from each other to the second foot-part fitting, one of the fifth and the sixth articulated levers is extended beyond a region of its articulation point on the second foot-part fitting and is articulated at its free end to a first end of the connecting lever and a second end of the connecting lever is articulated to the first foot-part fitting.

4. The piece of seating furniture of claim 1, wherein during a first partial phase of the adjustment of the piece of seating furniture from the sitting to the reclining position, the coupling lever is lowered relative to the seat part, wherein at the same time the articulation point of the one of the fifth and the sixth articulation levers on the second foot-part fitting is raised relative to the coupling lever, during a second partial phase, which follows the first partial phase, of the adjustment of the piece of seating furniture from the sitting position into the reclining position, the coupling lever is raised relative to the seat part, wherein the articulation point of the one of the fifth and the sixth articulated levers on the second foot-part fitting is simultaneously lowered relative to the coupling lever.

5. The piece of seating furniture of claim 1, wherein, during the adjustment of the piece of seating furniture from the sitting position to the reclining position, one of the first and the second articulated levers is pivoted relative to one of the third and the fourth articulated levers by an angle of at least 150°.

6. The piece of seating furniture of claim 1, wherein the first and the second articulated lever are each articulated to a front region of the seat part and are each articulated to the coupling lever, the third and the fourth articulated lever are each articulated to the coupling lever and are each articulated to the sixth articulated lever, one of the third and the fourth articulated levers is extended beyond its point of articulation on the coupling lever and is articulated at its free end to a first end of the control lever, a second end of which is articulated to a central region of one of the first and the second articulated levers, the third articulated lever, in the sitting position of the piece of seating furniture, is positioned closer to a vertical plane defined by the front edge of the seat part than the fourth articulated lever, and the fifth articulated lever is articulated to a central region of the third articulated lever and to the second foot-part fitting.

7. The piece of seating furniture of claim 1, wherein a front edge of the first footrest follows a flat movement curve near the front edge of the seat part during a first phase of pivoting from the sitting position to the reclining position, and a movement curve of an articulation point of the first foot-part fitting on the second foot-part fitting extends in an ascending manner with respect to a horizontal plane defined by the articulation point of the first foot-part fitting on the second foot-part fitting in the sitting position of the piece of seating furniture during an entire pivoting of the foot part from the sitting position into the reclining position.

8. The piece of seating furniture of claim 1, wherein the foot part comprises a first footrest fastened to the first foot-part fitting and a second footrest fastened to the second foot-part fitting, the first and the second foot-part fitting are coupled to one another in such a way that the first footrest fastened to the first foot-part fitting is moveable out of the sitting position, the second footrest fastened to the second foot-part fitting forms a front panel and the first footrest is pivoted in parallel below the seat part, into the reclining position, the second footrest forms with the first footrest an extension of the seat part adjoining the seat part, the first footrest is pivoted into a horizontal position extending an end of the pivoted-out second footrest facing away from the seat part.

9. The piece of seating furniture of claim 1, wherein the fifth and the sixth articulated lever form with the third or the fourth articulated lever and with the second foot-part fitting an intersecting four-bar chain, in which an imaginary connecting line extending through articulation points of the fifth articulated lever on the third or the fourth articulated lever and the second foot-part fitting and an imaginary connecting line passing through articulation points of the sixth articulated lever on the third or the fourth articulated lever and the second foot-part fitting intersect.

10. The piece of seating furniture of claim 1, wherein the first linear actuator, during the adjustment of the piece of seating furniture from the sitting position to the reclining position, causes an extension of the foot part relative to the seat part with the second partial stroke following the first partial stroke of the first linear actuator.

11. The piece of seating furniture of claim 1, wherein the first linear actuator, during the adjustment of the piece of seating furniture from the sitting to the reclining position, with the second partial stroke following the first partial stroke of the first linear actuator, while maintaining an inclination and displacement position of the seat part relative to the chassis achieved at an end of the first partial stroke and while maintaining a position of the back part relative to the seat part, effects an extension of the foot part relative to the seat part.

12. The piece of seating furniture of claim 1, wherein during the adjustment of the piece of seating furniture from the sitting to the reclining position, the second linear actuator generates a linear stroke when actuated and, while maintaining a position of the foot part relative to the seat part, causes a forward displacement of the seat part relative to the chassis, wherein simultaneously with the displacement movement of the seat part relative to the chassis a pivoting of the back part relative to the seat part occurs.

13. The piece of seating furniture of claim 1, wherein the seat part is displaced relative to the chassis via a first and a second displacement unit to adjust the piece of seating furniture between the sitting and the reclining position, the first displacement unit is attached to the seat part and to the second displacement unit, the second displacement unit is attached to the chassis, and the first displacement unit is guided displaceably relative to the chassis.

14. The piece of seating furniture of claim 13, wherein the first displacement unit comprises a pivot guide, a front link, and a rear link arm forming a four-bar chain with the seat part and an intermediate support connected to the second displacement unit, a pivoting movement of the first displacement unit in a direction of the front edge of the piece of seating furniture is blocked by a stop element on the seat part.

15. The piece of seating furniture of claim 14, wherein the second displacement unit is formed by at least one linear guide in the form of a rack-and-pinion gear or by a lever adjustment mechanism, and the at least one linear guide, starting from the sitting position of the piece of seating furniture, is movable forwards along a movement path relative to the chassis along a movement path that rises in a forward direction.

16. The piece of seating furniture of claim 14, wherein the first displacement unit is force-loaded by at least one tension spring, and the tension spring is coupled to the seat part and to the intermediate support of the first displacement unit.

17. The piece of seating furniture of claim 14, wherein the second linear actuator is coupled at a first end to the chassis and at a second end to the first displacement unit via a first transverse strut connected to the intermediate support of the first displacement unit.

18. The piece of seating furniture of claim 17, wherein the first linear actuator is coupled at a first end to the first displacement unit via the first transverse strut connected to the intermediate support of the first displacement unit, and at a second end to the foot-part adjustment mechanism via a second transverse strut connected to the foot-part adjustment mechanism.

19. The piece of seating furniture of claim 18, wherein the first transverse strut is guided displaceably relative to the chassis and to the seat part.

20. The piece of seating furniture of claim 19, wherein the second linear actuator is coupled at a first end to the chassis and at a second end to the first transverse strut, and the first linear actuator is coupled at a first end to the first transverse strut and at a second end to the foot-part adjustment mechanism via a second transverse strut, which is connected to the foot-part adjustment mechanism.

21. The piece of seating furniture of claim 1, wherein, during the adjustment of the piece of seating furniture from the reclining position to the sitting position, a pivoting movement of the foot part caused by the first partial stroke of the first linear actuator is blocked by a stop element, and by generating the second partial stroke following the first partial stroke of the first linear actuator, a rearward displacement of the seat part relative to the chassis and a simultaneous inclination adjustment of the seat part occurs.

* * * * *